US009903007B2

(12) United States Patent
Haga et al.

(10) Patent No.: US 9,903,007 B2
(45) Date of Patent: Feb. 27, 2018

(54) HYPEREUTECTIC ALUMINUM-SILICON ALLOY DIE-CAST MEMBER AND PROCESS FOR PRODUCING SAME

(71) Applicant: JOSHO GAKUEN EDUCATIONAL FOUNDATION, Osaka-shi, Osaka (JP)

(72) Inventors: Toshio Haga, Osaka (JP); Hiroshi Fuse, Osaka (JP)

(73) Assignee: JOSHO GAKUEN EDUCATIONAL FOUNDATION, Osaka-Shi (JP)

( * ) Notice: Subject to any disclaimer, the term of this patent is extended or adjusted under 35 U.S.C. 154(b) by 0 days.

(21) Appl. No.: 14/430,594

(22) PCT Filed: Sep. 24, 2013

(86) PCT No.: PCT/JP2013/075705
§ 371 (c)(1),
(2) Date: Mar. 24, 2015

(87) PCT Pub. No.: WO2014/050815
PCT Pub. Date: Apr. 3, 2014

(65) Prior Publication Data

US 2015/0275335 A1 Oct. 1, 2015

(30) Foreign Application Priority Data

Sep. 25, 2012 (JP) ..... 2012-211241

(51) Int. Cl.
*C22C 21/02* (2006.01)
*B22D 17/30* (2006.01)
(Continued)

(52) U.S. Cl.
CPC ..... *C22C 21/02* (2013.01); *B22D 17/10* (2013.01); *B22D 17/30* (2013.01); *B22D 21/007* (2013.01);
(Continued)

(58) Field of Classification Search
CPC ..... C22C 21/02; C22C 21/04
See application file for complete search history.

(56) References Cited

U.S. PATENT DOCUMENTS 4,969,428 A 11/1990 Donahue et al.
5,234,514 A 8/1993 Donahue et al.
(Continued)

FOREIGN PATENT DOCUMENTS

JP 58-16038 A 1/1983
JP 9-87768 A 3/1997
(Continued)

OTHER PUBLICATIONS

Al (Aluminum) Binary Alloy Phase Diagrams, Alloy Phase Diagrams, vol. 3, ASM Handbook, ASM International, 1992, p. 2.4-2.56.*
(Continued)

*Primary Examiner* — Colleen P Dunn
*Assistant Examiner* — Nicholas A Wang
(74) *Attorney, Agent, or Firm* — Birch, Stewart, Kolasch & Birch, LLP

(57) ABSTRACT

The present invention provides a hypereutectic aluminum-silicon alloy die-cast member which contains 20.0% by mass to 30.0% by mass of silicon and also has a thickness of 2.5 mm or less, and a method for producing the same.

Disclosed is a die-cast member made of a hypereutectic aluminum-silicon alloy containing 20.0% by mass to 30.0% by mass of silicon, wherein the die-cast member has a thickness of 2.5 mm or less and an average size of primary crystal Si is 0.04 mm to 0.20 mm.

4 Claims, 10 Drawing Sheets

(51) Int. Cl.

| | |
|---|---|
| ***B22D 21/04*** | (2006.01) |
| ***B22D 17/10*** | (2006.01) |
| ***C22C 21/04*** | (2006.01) |
| ***B22D 21/00*** | (2006.01) |

(52) U.S. Cl.
CPC ..... *B22D 21/04* (2013.01); *C22C 21/04* (2013.01); *Y10T 428/12* (2015.01)

(56) References Cited

U.S. PATENT DOCUMENTS

| | | | | |
|---|---|---|---|---|
| 5,891,273 | A | 4/1999 | Rückert et al. | |
| 2001/0031218 | A1 | 10/2001 | Suzuki et al. | |
| 2002/0017371 | A1 | 2/2002 | Sakamoto et al. | |
| 2004/0238150 | A1 | 12/2004 | Adachi et al. | |
| 2007/0012173 | A1* | 1/2007 | Kurita ..... | B22D 30/00 92/169.1 |

FOREIGN PATENT DOCUMENTS

| | | | | |
|---|---|---|---|---|
| JP | H09087768 | | * | 3/1997 |
| JP | 10-152731 | A | | 6/1998 |
| JP | H10152731 | | * | 6/1998 |
| JP | 11-226723 | A | | 8/1999 |
| JP | H11226723 | | * | 8/1999 |
| JP | 2000-15414 | A | | 1/2000 |
| JP | 2000-343198 | A | | 12/2000 |
| JP | 2001-288526 | A | | 10/2001 |
| JP | 2001288526 | | * | 10/2001 |
| JP | 2001-316748 | A | | 11/2001 |

OTHER PUBLICATIONS

Supplementary European Search Report issued in Application No. 13842276.1 dated Jun. 28, 2016.

English Translation of International Preliminary Report on Patentability dated Mar. 26, 2015 of International Application No. PCT/JP2013/075705.

International Search Report, issued in PCT/JP2013/075705, dated Dec. 3, 2013.

* cited by examiner (a)

(b)

Relation between injection starting temperature and silicon content, and die-castability (a)

(b)

HYPEREUTECTIC ALUMINUM-SILICON ALLOY DIE-CAST MEMBER AND PROCESS FOR PRODUCING SAME

TECHNICAL FIELD

The present invention relates to a hypereutectic aluminum-silicon alloy die-cast member and a method for producing same, and particularly to a hypereutectic aluminum-silicon alloy die-cast member which contains 20.0% by mass to 30.0% by mass of silicon and has a thickness of 2.5 mm or less, and a method for producing same.

BACKGROUND ART

A hypereutectic aluminum-silicon alloy containing silicon with the composition at a eutectic point or more, i.e. 12.6% by mass or more of aluminum (Al)-silicon (Si) alloy has a small linear thermal expansion coefficient and also has excellent wear resistance. This is because silicon content with the composition at a eutectic point or more enables formation of a primary crystal Si during solidification, and these are characteristics which are not obtained in a hypoeutectic aluminum-silicon alloy in which the silicon content is less than the composition at a eutectic point (i.e. less than 12.6% by mass) and a primary crystal Al is formed.

Particularly, when the silicon content is within a range of 20.0% by mass to 30.0% by mass, a sufficient amount of a primary crystal Si is obtained and thus the linear thermal expansion coefficient more decreases to a linear thermal expansion coefficient which is almost the same as that of copper. Wear resistance is also significantly improved and, furthermore, the obtained alloy has high thermal conductivity.

Therefore, the hypereutectic aluminum-silicon alloy having the silicon content of 20.0% by mass to 30.0% by mass is expected to have a wide application field, including applications such as a substrate for semiconductor device, including a wiring made of metal such as copper on a surface thereof, and various housings (casings).

However, the hypereutectic aluminum-silicon alloy has a problem that it is difficult to obtain a desired shape by secondary forming process because of poor workability after casting.

Therefore, a die casting method has been proposed, as a method for casting a hypereutectic aluminum-silicon alloy having poor workability into a desired shape.

The die casting method is capable of easily obtaining a final shape or a shape close to a final shape, and has an advantage that there is no need to subject the obtained die-cast member to the steps of grinding and polishing. Even if these steps are performed, it is easy to perform by slight machining.

However, it is believed that the silicon content of more than 17% leads to poor fluidity of a molten metal and that the hypereutectic aluminum-silicon alloy having the silicon content of 20.0% by mass to 30.0% by mass exhibits considerably poor fluidity of the molten metal, and thus it is difficult to perform die casting by a conventional die casting apparatus even in the case of not only a thin-wall member but also a usual member. Therefore, die casting was scarcely performed.

Namely, even if the hypereutectic aluminum-silicon alloy containing 20.0% by mass to 30% by mass of silicon is used as a mother alloy (silicon source) so as to obtain a die-cast member of an aluminum-silicon alloy with lower silicon content, a die-cast member of the hypereutectic aluminum-silicon alloy containing 20.0% by mass to 30% by mass of silicon scarcely existed as a practical material.

This becomes apparent from the fact that Patent Document 1 discloses a high thermal conductivity alloy for pressure casting (die casting), containing 5 to 16% of silicon, and also mentions that fluidity becomes maximum when the silicon content is about 15% while castability deteriorates when the silicon content becomes 16% or more.

Regarding the range where the silicon content is less than 20.0% by mass, for example, Patent Document 2 discloses a method in which a molten metal is poured into a sleeve and the molten metal is held at a temperature range between the crystallization temperature of a primary crystal Si and the eutectic temperature, followed by injecting molding to obtain a die-cast member, so as to obtain a wear-resistant member made of an aluminum-silicon alloy having the silicon content of 14 to 17% by weight.

In a range where the silicon content is close to a range of 20.0% by mass to 30.0% by mass, for example, Patent Document 3 discloses a method in which, so as to impart vibration-absorbing property by crystallizing a large primary crystal Si, a molten metal of an aluminum-silicon alloy containing 20 to 33% of silicon is held at a temperature lower than the liquidus temperature of the alloy for a comparatively long time, for example, one hour, and then die casting is performed in a state where the molten metal containing a large amount of the crystallized silicon.

Regarding the range where the silicon content is more than 30%, for example, Patent Document 4 discloses a method for producing a heat dissipation member using a die casting method, in which a molten metal of an aluminum-silicon alloy at 980° C., which is prepared by mixing 37% of silicon with aluminum as the balance and melting the mixture by high frequency induction melting in the Ar atmosphere, was poured in a die-cast mold, followed by compression forming at 920° C. for 3 seconds under 15 MPa.

Patent Document 1: JP 2001-316748 A
Patent Document 2: JP 11-226723 A
Patent Document 3: JP 58-16038 A
Patent Document 4: JP 2001-288526 A

DISCLOSURE OF THE INVENTION

Problems to be Solved by the Invention

Because of having excellent properties as mentioned above, the hypereutectic aluminum-silicon alloy having the silicon content within a range of 20.0% by mass to 30.0% by mass can be used in a wide application field, including applications, for example, heat spreaders of semiconductor device, such as CPU; base plates of electronic substrates on which semiconductor devices are disposed, such as IGBT; and heat sinks and lamp houses for light emitting devices, such as LED.

The hypereutectic aluminum-silicon alloy is exclusively used in a thin member having a thickness of 2.5 mm or less (preferably 2 mm or less, and more preferably 1 mm or less).

However, when the silicon content in an alloy among hypereutectic aluminum-silicon alloys increases to 20.0% by mass to 30.0% by mass, a primary crystal Si easily undergoes coarsening. Therefore, it becomes considerably difficult to perform die-cast forming as compared with a hypereutectic aluminum-silicon alloy having lower silicon content, thus making it extremely difficult to obtain a die-cast member having a thickness of 2 mm or less. Actually, it was extremely difficult to obtain a die-cast member having a thickness of 2.5 mm or less, not to mention a die-cast member having a thickness 2 mm or less.

As disclosed in Patent Document 1, it is believed that the silicon content of more than 16% by mass leads to deterioration of formability, and now available alloy has the silicon content of at most 17% like Patent Document 2. The method of Patent Document 2 has a problem that practicality of the obtained die-cast member deteriorates even if the silicon content is 17%. In other words, even if the die-cast member is obtained, surface defects such as cracks or surface wrinkles are often generated, thus failing to use in industry.

An object of the method disclosed in Patent Document 3 is originally to obtain a die-cast member having excellent vibration-absorbing property, and for this reason, it is aimed to make a primary crystal Si to have a length of about 200 μm to 1,000 μm or more by coarsening. Since the coarsened primary crystal Si causes deterioration of castability (die castability), it is extremely difficult to obtain a die-cast member having a thickness 2.5 mm or less, not to mention a thickness of 2 mm or less.

Since the method disclosed in Patent Document 4 requires a high-temperature (980° C.) aluminum-silicon alloy molten metal, high frequency induction melting is employed, and the method requires a special apparatus for melting in the Ar atmosphere so as to prevent oxidation at high temperature. Therefore, facility costs and energy costs for heating are required. Since injection is performed at a high temperature of 920° C., head load on a die-cast mold is high and mold lifetime decreases, resulting in increased production costs.

Thus, an object of the present invention is to provide a hypereutectic aluminum-silicon alloy die-cast member which contains 20.0% by mass to 30.0% by mass of silicon and also has a thickness of 2.5 mm or less (preferably 2.0 mm or less). Another object thereof is to provide a hypereutectic aluminum-silicon alloy die-cast member which contains 20.0% by mass to 30.0% by mass of silicon and also has a thickness of 2.5 mm or less (preferably 2.0 mm or less) using a conventional die casting apparatus, without using especially expensive apparatuses such as a servo device, and a device for microcomputer control of location, speed, and pressure up of injection, or without using the step which causes deterioration of productivity; and a method for producing the same.

Means for Solving the Problems

A first aspect of the present invention is directed to a die-cast member made of a hypereutectic aluminum-silicon alloy containing 20.0% by mass to 30.0% by mass of silicon, wherein the die-cast member has a thickness of 2.5 mm or less and an average size of primary crystal Si is 0.04 mm to 0.20 mm.

A second aspect of the present invention is directed to the die-cast member according to the first aspect, wherein a surface area S and a thickness Tm of the die-cast member satisfy the following relations:

when $S \leq 50\ cm^2$, $Tm \leq 0.8$ mm, when $50\ cm^2 < S \leq 200\ cm^2$, $Tm \leq 1.2$ mm, when $200\ cm^2 < S \leq 1{,}000\ cm^2$, $Tm \leq 2.1$ mm, and when $1{,}000\ cm^2 < S$, $Tm \leq 2.5$ mm.

A third aspect of the present invention is directed to the die-cast member according to the first aspect, wherein the surface area is more than 50 $cm^2$ and 200 $cm^2$ or less, and the thickness is 1.2 mm or less.

A fourth aspect of the present invention is directed to the die-cast member according to the first aspect, wherein the surface area is 50 $cm^2$ or less, and the thickness is 0.8 mm or less.

A fifth aspect of the present invention is directed to the die-cast member according to any one of the first to fourth aspects, wherein the hypereutectic aluminum-silicon alloy consists of aluminum, silicon and inevitable impurities.

A sixth aspect of the present invention is directed to the die-cast member according to any one of the first to fourth aspects, wherein the hypereutectic aluminum-silicon alloy comprises aluminum (Al): 60.0% by mass or more, silicon (Si), and one or more selected from the group consisting of copper (Cu): 0.5% by mass to 1.5% by mass, magnesium (Mg): 0.5% by mass to 4.0% by mass, nickel (Ni): 0.5% by mass to 1.5% by mass, zinc (Zn): 0.2% by mass or less, iron (Fe): 0.8% by mass or less, manganese (Mn): 2.0% by mass or less, beryllium (Be): 0.001% by mass to 0.01% by mass, phosphorus (P): 0.005% by mass to 0.03% by mass, sodium (Na): 0.001% by mass to 0.01% by mass and strontium (Sr): 0.005% by mass to 0.03% by mass.

A seventh aspect of the present invention is directed to a method for producing a die-cast member, which includes the steps of 1) preparing a molten metal of a hypereutectic aluminum-silicon alloy containing 20.0% by mass to 30.0% by mass of silicon, the molten metal having a temperature higher than the liquidus temperature of the alloy, and supplying the molten metal in a sleeve; and 2) moving a plunger inserted into the sleeve immediately after the temperature of the molten metal in the sleeve reached a predetermined injection starting temperature at a temperature between the liquidus temperature and the eutectic temperature of the hypereutectic aluminum-silicon alloy, and injecting the molten metal in a semi-solidified state thereby filling a cavity of a mold with the molten metal.

An eighth aspect of the present invention is directed to the method according to the seventh aspect, wherein the injection starting temperature of the step 2) lies between the lower limit temperature $TL_1$ represented by the equation (1) shown below and the liquidus temperature of the hypereutectic aluminum-silicon alloy:

$$TL_1\ (°\ C.) = -0.46 \times [Si]^2 + 25.3 \times [Si] + 255 \quad (1)$$

where [Si] is the silicon content represented by % by mass of a hypereutectic aluminum-silicon alloy.

A ninth aspect of the present invention is directed to the method according to the seventh aspect, wherein the injection starting temperature of the step 2) lies between the lower limit temperature $TL_2$ represented by the equation (2) shown below and the liquidus temperature of the hypereutectic aluminum-silicon alloy:

$$TL_2\ (°\ C.) = -6 \times [Si] + 800 \quad (2)$$

where [Si] is the silicon content represented by % by mass of a hypereutectic aluminum-silicon alloy.

A tenth aspect of the present invention is directed to the method according to the seventh, eighth or ninth aspect, wherein, in the step 1), the temperature of the molten metal to be supplied in the sleeve is higher than the liquidus temperature of the hypereutectic aluminum-silicon alloy by a difference within 50° C.

An eleventh aspect of the present invention is directed to the method according to any one of the seventh to tenth aspects, wherein, in the step 1), the molten metal is allowed to flow on a cooling plate provided outside of the sleeve thereby cooling to temperature of the liquidus temperature or lower, and supplying the molten metal in the sleeve.

A twelfth aspect of the present invention is directed to the method according to any one of the seventh to eleventh aspects, wherein the hypereutectic aluminum-silicon alloy consists of aluminum, silicon and inevitable impurities.

A thirteenth aspect of the present invention is directed to the method according to any one of the seventh to tenth aspects, wherein the hypereutectic aluminum-silicon alloy comprises aluminum (Al): 60.0% by mass or more, silicon (Si), and one or more selected from the group consisting of copper (Cu): 0.5% by mass to 1.5% by mass, magnesium (Mg): 0.5% by mass to 4.0% by mass, nickel (Ni): 0.5% by mass to 1.5% by mass, zinc (Zn): 0.2% by mass or less, iron (Fe): 0.8% by mass or less, manganese (Mn): 2.0% by mass or less, beryllium (Be): 0.001% by mass to 0.01% by mass, phosphorus (P): 0.005% by mass to 0.03% by mass, sodium (Na): 0.001% by mass to 0.01% by mass and strontium (Sr): 0.005% by mass to 0.03% by mass.

Effects of the Invention

According to the present invention, it becomes possible to provide a hypereutectic aluminum-silicon alloy die-cast member which contains 20% by mass to 30% by mass of silicon, and also has a thickness of 2.5 mm or less (preferably 2.0 mm or less). It also becomes possible to provide a method for producing a hypereutectic aluminum-silicon alloy die-cast member which contains 20% by mass to 30% by mass of silicon, and also has a thickness of 2.0 mm or less.

BRIEF DESCRIPTION OF THE DRAWINGS

FIG. 4 is a graph showing a relation between the injection starting temperature and the silicon content, and the die castability with.

MODE FOR CARRYING OUT THE INVENTION

Figure 1:
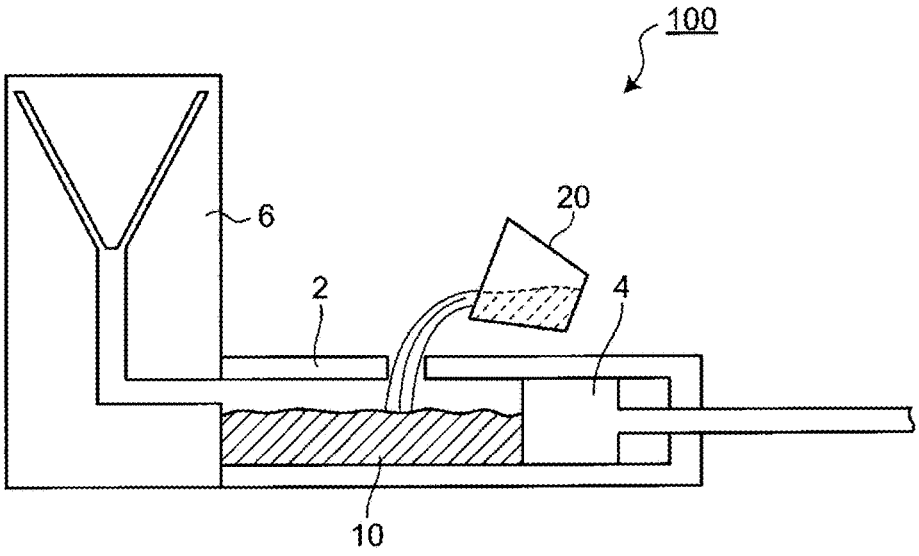
FIG. 1 is a schematic cross-sectional view schematically showing a die casting apparatus (die casting machine) 100 which is used for the production of a die-cast member according to the present invention, in which FIG. 1(*a*) shows a state before filling a mold 6 with a molten metal and FIG. 1(*b*) shows a state after filling a mold 6 with a molten metal 10.
Figure 1:
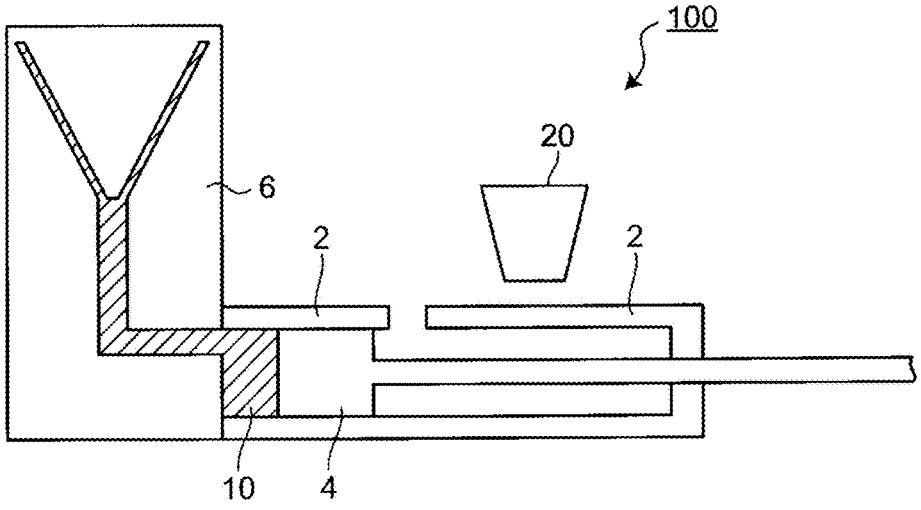

Embodiments of the present invention will be described in detail below with reference to the accompanying drawings. In the description below, if necessary, the terms indicative of the specific direction or position (for example, "upper", "lower", "right", "left", and other words including these words) are used for easy understanding of the present invention with reference to the drawings. The meanings of the terms do not limit the scope of the present invention in the present application. The same parts or members are designated by the same reference numerals throughout the drawings.

The inventors have intensively studied and found that a die-cast member having a thickness of 2.5 mm or less, and a die-cast member having a thickness of 2.0 mm or less or 1.0 mm or less can be obtained by supplying a molten metal of a hypereutectic aluminum-silicon alloy containing 20.0% by mass to 30.0% by mass of silicon in a sleeve; moving a plunger inserted into the sleeve immediately after the temperature of the molten metal in the sleeve reached a predetermined injection starting temperature at a temperature between the liquidus temperature and the eutectic temperature of the hypereutectic aluminum-silicon alloy; and injecting the molten metal in a semi-solidified state thereby filling a cavity of a mold with the molten metal.

The inventors have intensively studied and found that a die-cast member having a thickness of 2.5 mm or less, and a die-cast member having a thickness of 2.0 mm or less or 1.0 mm or less can be obtained by supplying a molten metal of a hypereutectic aluminum-silicon alloy containing 20.0% by mass to 30.0% by mass of silicon in a sleeve; moving a plunger inserted into the sleeve immediately after the temperature of the molten metal in the sleeve reached a predetermined injection starting temperature at a temperature between the liquidus temperature and the eutectic temperature of the hypereutectic aluminum-silicon alloy; and injecting the molten metal in a semi-solidified state thereby filling a cavity of a mold with the molten metal.

Namely, the present invention is characterized in that a so-called semi-solidification die casting method is applied to a hypereutectic aluminum-silicon alloy containing 20.0% by mass to 30.0% by mass of silicon and, in that case, upon reaching a predetermined injection starting temperature, filling in a die casting machine (cavity of mold) is immediately started. The inventors have first found that use of such die casting method enables suppression of coarsening of a primary crystal Si, leading to high castability (die castability), thus obtaining a die-cast member having a thickness of 2.5 mm or less (or having a thickness of 2.0 mm or less or a thickness of 1.0 mm or less) without causing problematic surface defects such as cracks and surface wrinkles.

There has not been completely elucidated the reason why a die-cast member, made of a hypereutectic aluminum-silicon alloy containing 20.0% by mass to 30.0% by mass of silicon, having a thickness 2.5 mm (preferably 2.0 mm or less) is obtained by the production method of the present invention.

A mechanism presumed by the inventors based on findings, which have been obtained up to the present, is as follows. Note that the mechanism, which will be stated below, is not intended to limit the scope of the present invention.

In many cases, according to a die casting method, a cavity of a mold is filled with a molten metal having a liquidus temperature or higher of an alloy to be used. In other words, in the hypereutectic aluminum-silicon alloy, a cavity of a mold is filled with a molten metal in a state where a primary crystal Si is not crystallized. In this case, since the molten metal has a high temperature, surface defects such as seizure to a surface of the obtained die-cast member, blistering due to gas entrainment, and surface wrinkles are likely to be caused by partial fusion of the molten metal to a mold.

Meanwhile, even if a semi-solidification die casting method is applied, since the molten metal is held in a semi-solidified state for a comparatively long time in a conventional semi-solidification die casting method, silicon content of 20% by mass or more easily causes the growth of the primary crystal Si, leading to coarsening. When coarsened primary crystal Si exists, fluidity of the molten metal is likely to deteriorate, and thus the mold is unfilled with the molten metal (a cavity of a mold is not filled partially with the molten metal). This tendency becomes remarkable as the thickness of the die-cast member becomes thinner, namely, gap (or width) of the cavity of the mold becomes narrower. Coarsening of the primary crystal Si sometimes generates a starting point of cracks.

To the contrary, in the production method according to the present invention, as mentioned above, upon reaching a predetermined injection starting temperature, filling in the cavity of the mold is immediately started and the primary crystal Si thus formed becomes fine. Therefore, since fluidity of the molten metal is held, even a mold having a thickness of 2.0 mm or less (or a thickness of 1.0 mm or less) can be filled with the molten metal without causing unfilling as a result of solidification before filling the mold with the molten metal. Because of large silicon content of 20.0% by mass to 30.0% by mass, numerous fine primary crystals Si are crystallized. The molten metal containing such fine primary crystals Si (molten metal in a semi-solidified state) is less likely to be partially fused to the mold and generates fewer cracks, thus obtaining a die-cast member which has excellent castability and includes extremely less surface defects.

The reason why neither cracks nor fusion to the mold generates when numerous fine primary crystals Si are crystallized is considered as follows. Regarding cracks, a primary crystal Si scarcely serve as a starting point of cracks, like the coarsened primary crystal Si, because of its fineness. Meanwhile, regarding fusion, it is considered that the molten metal in a semi-solidified state has a low temperature as compared with a state where the molten metal is entirely composed of a liquid phase, and also a fine primary crystal Si acts as a mold release agent of the molten metal, thus suppressing fusion of the molten metal to the mold.

The method for producing a die-cast member according to the present invention, and the die-cast member obtained by the production method will be described in detail below.

1. Method for Producing Die-Cast Member (1) First Embodiment

FIG. 1 is a schematic cross-sectional view schematically showing a die casting apparatus (die casting machine) 100 used for the production of a die-cast member according to the present invention, in which FIG. 1(*a*) shows a state before mold 6 is filled with a molten metal and FIG. 1(*b*) shows a state after filling a mold 6 with a molten metal 10.

The die casting apparatus 100 is shown as an example capable of carrying out the production method of the present invention, and the die casting apparatus which can be used in the present invention is not limited thereto. A die casting machine with any existing constitution may be used as long as it is capable of carrying out the below-mentioned production method of the present invention.

The die casting apparatus 100 includes a sleeve 2 capable of accommodating a molten metal 10 supplied from a ladle 20 in a hollow cavity inside, a plunger (injection portion) 4 which moves in the hollow cavity of the sleeve 2 and pressurizes the molten metal 10 in the sleeve 2 to eject (discharge) the molten metal out of the sleeve 2, and a mold 6 to be filled with molten metal 10 discharged from the sleeve 2.

The mold 6 forms the cavity having a shape of the product to be obtained. In the present invention, the mold 6 is constituted such that a die-cast member obtained by filling the cavity formed in the mold 6 with a molten metal, followed by solidification of the molten metal has a thickness of 2.5 mm or less (2.0 mm or less in one of preferred embodiments).

In the embodiment shown in FIGS. 1(*a*) and 1(*b*), the cavity formed by the mold 6 has a megaphone shape extending toward an upper direction of FIG. 1(*a*) and may have any shape as long as the thickness of the die-cast member includes the portion of 2.5 mm or less.

The die casting apparatus 100 shown in FIGS. 1(*a*) and 1(*b*) is a cold chamber type die casting machine in which a molten metal is supplied thereinto using a ladle without dipping a sleeve in the molten metal. In the present invention, it is also possible to use a hot chamber type one in which a molten metal is supplied thereinto in a state where a sleeve is disposed in the molten metal. However, as mentioned in detail below, since the molten metal is cooled to a predetermined injection starting temperature in the sleeve 2, a cold chamber type one capable of easily cooling the molten metal is preferably used.

The production method of a first embodiment using a die casting apparatus 100 will be described below.

A molten metal 10 of a hypereutectic aluminum-silicon alloy containing 20% by mass to 30% by mass of silicon is supplied into a sleeve 2 from a ladle 20.

The temperature of the molten metal 10 to be supplied into the sleeve 2 from the ladle 20 (temperature of the molten metal when entering into the sleeve 2) is the temperature higher than the liquidus temperature of a hypereutectic aluminum-silicon alloy which constitutes the molten metal 10. When the molten metal is held at the temperature of the liquidus temperature or lower (in a semi-solidified state) in the ladle 20 for a long period of time, a primary crystal Si is crystallized, followed by growing and further coarsening. Therefore, in the present embodiment, substantial crystallization of the primary crystal Si is prevented until the molten metal 10 enters into the sleeve 2 so as to avoid growing and coarsening.

As mentioned in detail below, in the present embodiment, the primary crystal Si is first crystallized after the molten metal 10 substantially enters into the sleeve 2, and a mold 6 is filled with the molten metal 10 immediately after starting of crystallization to obtain a fine primary crystal Si, thus obtaining high castability (namely, a thin die-cast product is obtained).

The temperature of the molten metal 10 to be supplied into the sleeve 2 is preferably higher than the liquidus temperature by a difference within 50° C. (temperature of the liquidus temperature+50° C. or lower). This is because a larger quantity of heat is supplied to the sleeve 2 when the temperature of the molten metal 10 increases, leading to a decrease in rate of cooling of the molten metal 10 to the injection starting temperature. The present embodiment also has the effect capable of suppressing damage of the sleeve 2 due to heat and suppressing energy requiring melting and holding of the molten metal to be low.

The temperature of the molten metal 10 to be supplied to the sleeve 2 is more preferably higher than the liquidus temperature by a difference within a range of 20° C. or higher and 50 or lower (liquidus temperature+20° C. to liquidus temperature+50° C.). This reason is that formation of a primary crystal Si in the molten metal 10 can be more surely prevented before entering into the sleeve 2 by increasing the temperature of the molten metal 10 to be supplied to the sleeve 2 by 20° C. or higher than the liquidus temperature. Holding of the molten metal temperature at the temperature of lower than the liquidus temperature+20° C. may cause solidification of the molten metal due to a change in the temperature of the molten metal.

As used herein, the liquidus temperature means the temperature at which the entire composition (which is substantially the same as the composition of the obtained die-cast member) of the molten metal 10 becomes a liquid phase and can be usually determined using the components of the molten metal 10 in an equilibrium diagram. For example, when the molten metal 10 consists of aluminum, silicon and inevitable impurities, the liquidus temperature can be determined by an Al—Si equilibrium diagram.

Meanwhile, when the molten metal 10 contains, in addition to aluminum and silicon, elements added intentionally, the liquidus temperature can be determined by a multicomponent equilibrium diagram including additional elements, or by actual measurement. However, a multicomponent phase diagram may be sometimes unavailable depending on the component system, and it may be difficult to ensure measurement accuracy for actual measurement of the liquidus temperature. Therefore, when the amount of aluminum is 60% by mass or more (therefore, when the molten metal 10 contains aluminum: 60% by mass or more and silicon: 20% by mass to 30% by mass), the liquidus temperature may be determined using an Al—Si equilibrium diagram.

This shall also be applied to the eutectic temperature. Namely, the eutectic temperature can be determined using an equilibrium diagram corresponding to the component system of the molten metal 10. For example, when the molten metal 10 consists of aluminum, silicon and inevitable impurities, the value (577° C.) determined from the Al—Si equilibrium diagram can be used.

Meanwhile, when the molten metal 10 contains aluminum and elements added intentionally in addition to silicon, the eutectic temperature can be determined by a multicomponent equilibrium diagram including these additional elements, or actual measurement. However, it may be difficult to obtain the multicomponent phase diagram depending on the component system and to ensure measurement accuracy of the eutectic temperature. Therefore, if the amount of aluminum is 60% by mass or more (and, therefore, the molten metal 10 contains aluminum: 60% by mass or more and silicon: 20% by mass to 30% by mass), the eutectic temperature (577° C.) may be determined using the Al—Si equilibrium diagram.

The molten metal 10 is supplied in the amount enough to fill the cavity of a mold 6 in the sleeve 2 and, immediately after the molten metal reaches the injection starting temperature predetermined to the temperature between the eutectic temperature and the liquidus temperature (namely, a temperature range in which the molten metal 10 is in a semi-solidified state), a plunger 4 is moved from a right direction to a left direction of FIG. 1(*a*) and the molten metal 10 is injected, and then the cavity formed in a mold 6 is filled with the molten metal 10 as shown in FIG. 1(*b*).

Here, the injection starting temperature may be any temperature between the eutectic temperature and the liquidus temperature. The amount of the primary crystal Si crystallized in the molten metal 10 to be injected (filled) in the cavity of the mold 6 can be adjusted by changing this injection starting temperature. In other words, when the injection starting temperature is increased, the amount of the primary crystal Si decreases (and thus the amount of the liquid phase increases). When the injection starting temperature is decreased, the amount of the primary crystal Si increases (and thus the amount of the liquid phase decreases).

Preferably, the injection temperature lies between lower limit temperature $TL_1$ represented by the following equation (1) and the liquidus temperature:

$$TL_1\ (^\circ\ \mathrm{C.})=-0.46\times[\mathrm{Si}]^2+25.3\times[\mathrm{Si}]+255 \quad (1)$$

where [Si] is the silicon content represented by % by mass of a molten metal 10 (i.e. hypereutectic aluminum-silicon alloy).

As mentioned in detail in the following Examples, this equation (1) is experimentally determined (see FIG. 4) and can suppress a problem that the mold is not filled if the temperature is a temperature of the lower limit temperature $TL_1$ or higher (upper limit is liquidus temperature).

Meanwhile, when the injection starting temperature is the eutectic temperature or higher, and lower than the lower limit temperature $TL_1$, unfilling may occurs depending on the conditions such as shape and thickness of a mold.

More preferably, the injection starting temperature lies between the lower limit temperature $TL_2$ represented by the following equation (2) and the liquidus temperature:

$$TL_2\ (^\circ\ \mathrm{C.})=-6\times[\mathrm{Si}]+800 \quad (2)$$

where [Si] is the silicon content represented by % by mass of the molten metal 10 (i.e. hypereutectic aluminum-silicon alloy).

As mentioned in detail in the below-mentioned Examples, this equation (2) is experimentally determined (see FIG. 4), when the temperature is the temperature of the lower limit temperature $TL_2$ or higher (upper limit is the liquidus temperature), it is possible to suppress not only problematic surface defects such as cracks and surface wrinkles formed on a surface of the obtained die-cast member, but also the occurrence of micro-scale surface roughening corresponding to the level causing no problem in various uses.

Meanwhile, when the injection starting temperature is the eutectic temperature or higher and lower than the lower limit temperature $TL_2$, micro-scale surface roughening corresponding to the level causing no problem in various uses may occur.

As is apparent from the equation (2), the lower limit temperature $TL_2$ decreases as the silicon content increases. The reason is considered as follows. Since silicon exhibits large latent heat of solidification (silicon: 833 kJ/mol, aluminum: 293 kJ/mol) as compared with aluminum, and quantity of latent heat of solidification released when silicon is crystallized increases as the silicon content increases, solidification does not quickly occur even if the injection temperature is low.

The temperature of the molten metal 10 in the sleeve 2 may be measured by a contact thermometer such as a thermocouple, or a non-contact thermometer. After measuring a cooling rate (time lapse of molten metal temperature) of the molten metal in the sleeve in advance, using these temperature measurement means, the temperature of the molten metal in the sleeve may be determined by performing time management using the measured cooling rate.

In the production method according to the present invention, upon reaching the injection starting temperature, a plunger 4 is immediately activated and injection of the molten metal 10 is started, thus making it possible to prevent deterioration of castability as a result of growing and coarsening of the crystallized primary crystal Si.

As used herein, "immediately" means that the plunger 4 is activated without intentionally delay after confirming that the temperature of the molten metal 10 has reached the starting temperature.

Whereby, as shown in FIG. 1(*b*), the cavity of a mold 6 is filled with the molten metal 10 in a semi-solidified state. It is preferred that the mold 6 is left to stand at normal temperature before being filled with the molten metal 10, and is not heated by a heater during being filled with the molten metal 10. This is because coarsening of a primary crystal Si due to delay of cooling of the molten metal 10 in a semi-solidified state is suppressed. Therefore, the mold 6 may be optionally cooled, for example, by a method of water-cooling the outer periphery.

Regarding die casting conditions other than those described above, the injection rate is preferably 0.1 m/s or more, and more preferably 0.2 m/s or more. Even if the injection rate is lower than usual molten metal die-casting injection rate, for example, about 1.0 m/s, a die-cast member having a thickness of 1.0 mm or less can be obtained without causing unfilling because of satisfactory fluidity.

Use of the method described above enables the obtainment of a die-cast member, made of a hypereutectic aluminum-silicon alloy containing 20.0% by mass to 30.0% by mass of silicon, having a thickness of 2.5 mm or less. Actually, it is possible to obtain a die-cast member having a thickness smaller than the above-mentioned thickness of 2.5 mm or less, for example, 2.1 mm or less, 1.2 mm or less, or 0.8 mm or less.

It is known that the fact as to how thin the die-cast member can be surely obtained depends on an area of a die-cast member to be obtained. Namely, Leivy illustrates that a thinner die-cast member is obtained as the area of a single plane of a die-cast member becomes smaller in an aluminum alloy.

Thus, the inventors have studied a relation between the area and the obtainable thickness in a die-cast member made of a hypereutectic aluminum-silicon alloy containing 20.0% by mass to 30.0% by mass of silicon by using the method according to the present invention.

Leivy used, as the area, the area of the single plane as mentioned above. However, the inventors have studied a relation between the surface area of the die-cast member: S and the stably obtainable thickness: Tm, so as to be capable of coping with the case of having a curved surface and the case of having a complex shape, thus obtaining the following relations:

when S is 50 $cm^2$ or less, Tm is 0.8 mm or less (when $S \leq 50\ cm^2$, $Tm \leq 0.8$ mm (I)), when S is more than 50 $cm^2$ and 200 $cm^2$ or less, Tm is 0.8 mm or less (when $50\ cm^2 < S \leq 200\ cm^2$, $Tm \leq 1.2$ mm (II)), when S is more than 200 $cm^2$ and 1,000 $cm^2$ or less, Tm is 2.1 mm or less (when $200\ cm^2 < S \leq 1{,}000\ cm^2$, $Tm \leq 2.1$ mm (III)), and when S is more than 1,000 $cm^2$, Tm is 2.5 mm or less (when $1{,}000\ cm^2 < S$, $Tm \leq 2.5$ mm (IV)).

Note that the surface area S means an area of a die-cast member having a thickness Tm, which can be obtained stably, and does not mean that it is impossible to obtain a die-cast member having a surface area larger than S and a thickness Tm.

The surface area S means a surface area of a product portion which is actually used as a product of the die-cast member. For example, a runner to be removed after die casting is not included.

When one member includes a plurality of thin portions at comparatively small intervals (e.g. within 7 mm or less) (e.g. thin portions (portions in which the thickness is within a range of Tm defined by at least one of the above equations (I) to (IV)) are connected to each other at a thinner portion), the total areas of these thin portions may be calculated and regarded as a surface area S corresponding to the thickness Tm of the portions.

(2) Second Embodiment

Figure 2:
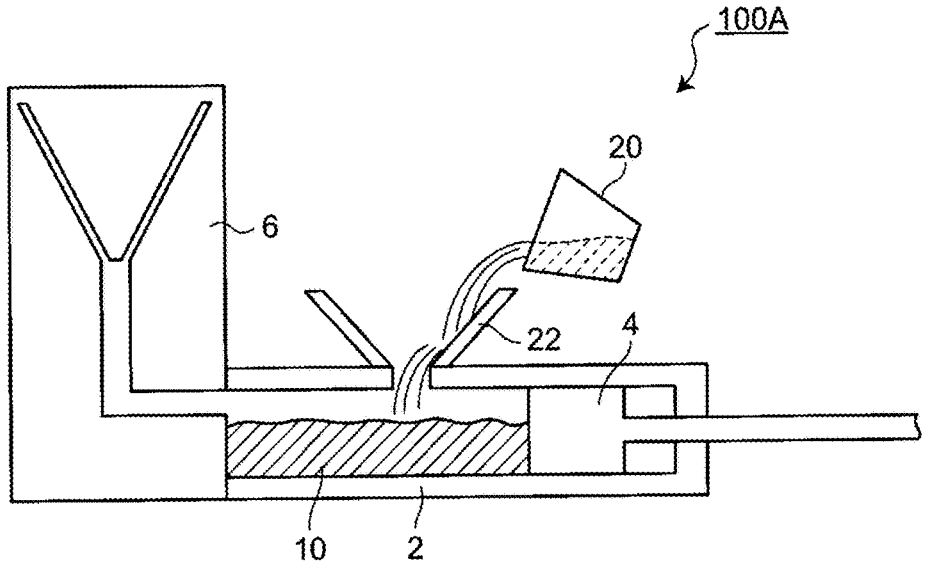
FIG. 2 is a schematic cross-sectional view schematically showing a die casting apparatus 100A which is used in a second embodiment of the production method according to the present invention.
Figure 3:
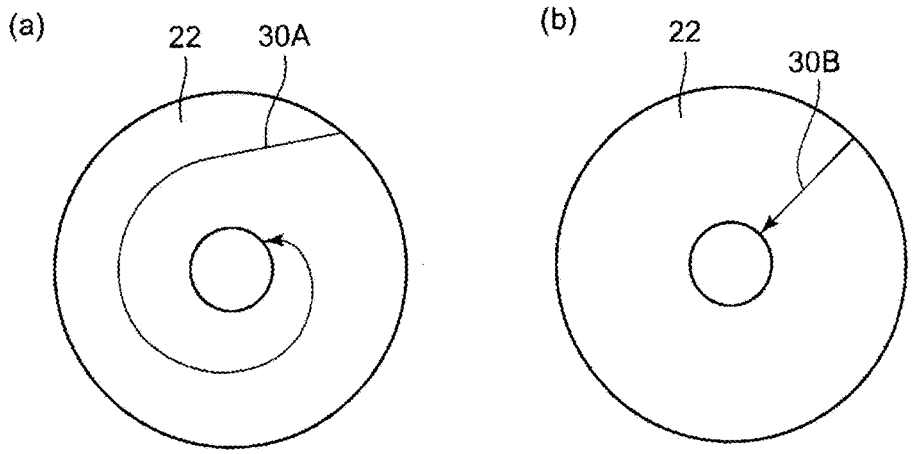
FIG. 3 is a top view schematically showing flow of a molten metal inside a cooling device 22, in which FIG. 3(*a*) shows a preferred form and FIG. 3(*b*) shows a common form.

FIG. 2 is a schematic cross-sectional view schematically showing a die casting apparatus 100A used in a second embodiment of the production method according to the present invention. FIG. 3 is a top view schematically showing flow of a molten metal inside a cooling device 22, in which FIG. 3(*a*) shows a preferred form and FIG. 3(*b*) shows a common form.

The die casting apparatus 100A differs from the above-mentioned die casting 100 in that the molten metal inlet, through which a molten metal 10 is supplied in a sleeve 2, is provided with a cooling device 22.

Constitutions other than this may be the same as those in the die casting apparatus 100.

Using the cooling device 22, the molten metal 10 discharged from the ladle 20, having the temperature higher than the liquidus temperature is cooled to the temperature which is the liquidus temperature or lower and higher than the injection starting temperature, and then the thus cooled molten metal 10 is supplied in the sleeve 2.

It is possible to use, as the cooling device 22, a cooling device having any form used for cooling the molten metal. However, if it takes a long period of time to cool to the predetermined temperature of the liquidus temperature or lower, the crystallized primary crystal Si is coarsened. Therefore, the time required for the cooling device 22 to cool the molten metal 10 supplied from the ladle 20 to the temperature of the predetermined liquidus temperature or lower (temperature at which the molten metal is supplied in the sleeve 2) is within 5 seconds.

In order to suitably satisfy the cooling conditions, in the embodiment of FIG. 2, the cooling device 22 is, for example, a cooling plate having a megaphone shape (megaphone shape extending in an upper direction in FIG. 2) formed of metal such as steel. The molten metal 10 is supplied to the vicinity of the upper end of a top face (upper end side of inner face of a megaphone shape) from the ladle 20, cooled while the molten metal 10 flow while being in contact with the cooling plate, and then the molten metal 10 is supplied in the sleeve 2 from the center portion of the top face (lower end side of an inner face of a megaphone shape).

In this way, since the molten metal 10 is supplied in the sleeve 2 after quickly cooling to the temperature of the liquidus temperature or lower, the molten metal 10 more quickly reaches the injection starting temperature as compared with the case of cooling to the injection starting temperature from the temperature of the liquidus temperature or higher in the sleeve 2. Therefore, the primary crystal Si to be crystallized becomes fine, thus making it possible to obtain higher castability (die castability).

When the molten metal is cooled on a cooling plate having a megaphone shape, as shown in FIG. 3(*b*), the molten metal is often allowed to flow so that a flow passage 30B of the molten metal 10 becomes linear. However, in order to more efficiently cool the molten metal 10 on the cooling plate having a megaphone shape, as shown in FIG. 3(*a*), the molten metal 10 is preferably allowed to flow so that the flow passage 30A of the molten metal 10 becomes spiral. Shifting a pouring direction from the center (e.g. a pouring direction is allowed to correspond to a circumferential direction) enables the flow passage 30A of the molten metal 10 to become spiral.

In order to maintain high coolability of a cooling device (cooling plate) 22, it is preferred to cool the underside of the cooling surface by water cooling or air cooling.

2. Die-Cast Member

A die-cast member having a thickness of 2.5 mm or less (preferably 2.0 mm or less, and more preferably 1.0 mm or less) formed by such method according to the present invention includes a fine primary crystal Si.

More specifically, in many cases, the primary crystal Si has a plate-like shape in the case of a conventional method in which a semi-solidification treatment was performed before pouring into the sleeve, and the average size is about 1 mm. Meanwhile, in the present invention, the primary crystal Si has a massive shape or a rosette shape and the average size is within a range of 0.04 mm to 0.20 mm, and more preferably 0.06 mm to 0.10 mm.

Regarding the measurement of the size (average size) of the primary Si, each sample is cut at three different locations (root portion near injection side, center portion and tip side portion) of the die-cast member in the direction perpendicular to a molten metal flow direction. With respect to any position of a cross-section at three positions, an image is taken at a visual field dimension of 1 mm×0.7 mm by changing a magnification of an optical microscope. After framing so that thirty primary crystals Si having a complete shape are included in the visual field, the average size was determined by measuring the sizes of thirty primary crystals and also the average size of the primary crystal Si is determined by taking an average of the above three locations. The size of the primary crystal Si is determined by measuring a maximum diameter (maximum length) of the crystal.

3. Alloy Composition

The alloy composition of a molten metal 10 used in the present invention (i.e. alloy composition of the obtained die-cast member) will be described in more detail below.

The hypereutectic aluminum-silicon alloy of the present invention contains 20.0 to 30.0% by mass of silicon.

The reason why the silicon content is 20% by mass or more is as follows. As mentioned above, when a sufficient amount of a primary crystal Si is obtained, a linear thermal expansion coefficient further decreases to reach the same linear thermal expansion coefficient as that of copper, wear resistance is significantly improved, and furthermore it is possible to obtain high thermal conductivity. Meanwhile, when the silicon content is more than 30.0% by mass, coarsening of a primary crystal Si easily occurs, thus making it difficult to obtain sufficient castability.

In one of preferred embodiments, the hypereutectic aluminum-silicon alloy of the present invention contains silicon: 20.0 to 30.0% by mass, with the balance being aluminum and inevitable impurities.

However, the composition is not limited thereto and, as long as the hypereutectic aluminum-silicon alloy contains silicon: 20.0 to 30.0% by mass and 60% by mass of aluminum, any element may be further added for the purpose of improving various characteristics of the obtained die-cast member.

Examples of elements, which may be added for the purpose of improving characteristics, are shown below.

—Copper (Cu)

The hypereutectic aluminum-silicon alloy may contain 0.5 to 1.5% by mass of copper (Cu).

Copper has the effect of improving the strength of the obtained die-cast member.

In the case of addition, when the addition amount is less than 0.5% by mass, the effect thereof may not be sufficiently obtained. Meanwhile, the addition amount of more than 1.5% by mass may lead to a problem such as deterioration of ductility.

—Magnesium (Mg)

The hypereutectic aluminum-silicon alloy may contain 0.5 to 4.0% by mass of magnesium (Mg).

Magnesium is capable of improving the strength of the obtained die-cast member. An improvement in elongation enables an improvement in die castability. Strengthening of a matrix makes a surface state of the obtained die casting formed article beautiful. In order to surely obtain these effects, the alloy preferably contains 0.5% by mass or more of Mg. However, the addition amount of more than 4.0% by mass may lead to deterioration of toughness of the obtained die-cast member.

—Nickel (Ni)

The hypereutectic aluminum-silicon alloy may contain 0.5 to 1.5% by mass of nickel (Ni). Nickel has the effect of improving the strength of the obtained die-cast member.

In the case of addition, when the addition amount is less than 0.5% by mass, the effect thereof may not be sufficiently obtained. Meanwhile, the addition amount of more than 1.5% by mass may lead to a problem such as deterioration of ductility.

—Zinc (Zn)

The hypereutectic aluminum-silicon alloy may contain 0.2% by mass or less of zinc.

Zinc has the effect of improving fluidity of the molten metal. Meanwhile, the addition amount of more than 0.2% by mass may lead to deterioration of corrosion resistance.

—Iron (Fe)

The hypereutectic aluminum-silicon alloy may contain 0.8% by mass or less of iron (Fe).

Iron has the effect of improving wear resistance of the obtained die-cast member.

The addition amount of more than 0.8% by mass may lead to deterioration of ductility of the material.

—Manganese (Mn)

The hypereutectic aluminum-silicon alloy may contain 2.0% by mass or less of manganese (Mn).

The addition of manganese to the hypereutectic aluminum-silicon alloy has the effect of suppressing oxidation of a surface when the temperature of the alloy reaches a high temperature during casting, and during heating of plastic working.

In the case of adding, in order to surely obtain the effect, the alloy preferably contains 0.5% by mass or more of Mn.

However, the addition amount of more than 2.0% by mass may lead to a problem such as deterioration of ductility.

—Beryllium (Be)

The hypereutectic aluminum-silicon alloy may contain 0.001 to 0.01% by mass of beryllium (Be). Beryllium has the effect of refining a primary crystal Si to be crystallized.

However, the addition amount of less than 0.001% leads to less effect. Since the addition amount of more than 0.01% may lead to deterioration of toughness of the obtained die-cast member, the amount is preferably within a range of 0.001 to 0.01%.

—Phosphorus (P)

The hypereutectic aluminum-silicon alloy may contain 0.005 to 0.03% by mass of phosphorus (P). Phosphorus forms heterogeneous nuclear AlP (aluminum phosphide) which functions as a seed when a primary crystal Si is crystallized. When the content is less than 0.005% by mass, a sufficient amount of heterogeneous nuclear is not formed and thus the primary crystal Si may exert insufficient refining action. Meanwhile, since the addition effect of phosphorus is saturated when the addition amount is 0.03% by weight, the effect corresponding to the addition amount is not often obtained even if the addition amount is more than 0.03% by weight.

—Sodium (Na)

The hypereutectic aluminum-silicon alloy may contain 0.001 to 0.01% by mass of sodium (Na).

Sodium has the effect of refining a primary crystal Si. When the content of sodium is less than 0.001% by mass, the effect thereof may not be sufficiently obtained. Meanwhile, the amount of sodium of more than 0.01% by mass may lead to formation of a coarse Si phase.

—Strontium (Sr)

The hypereutectic aluminum-silicon alloy may contain 0.0005 to 0.03% by mass of strontium (Sr).

Strontium has the effect of refining a primary crystal Si. When the content of strontium is less than 0.0005% by mass, the effect thereof may not be sufficiently obtained. Meanwhile, the amount of strontium of more than 0.03% by mass may lead to formation of a compound containing Sr in a massive form.

In one of preferred embodiments, the hypereutectic aluminum-silicon alloy contains one or more selected from the group consisting of silicon: 20.0 to 30.0% by mass and copper (Cu): 0.5% by mass to 1.5% by mass, magnesium (Mg): 0.5% by mass to 4.0% by mass, nickel (Ni): 0.5% by mass to 1.5% by mass, zinc (Zn): 0.2% by mass or less, iron (Fe): 0.8% by mass or less, manganese (Mn): 2.0% by mass or less, beryllium (Be): 0.001% by mass to 0.01% by mass, phosphorus (P): 0.005% by mass to 0.03% by mass, sodium (Na): 0.001% by mass to 0.01% by mass, and strontium (Sr): 0.005% by mass to 0.03% by mass, with the balance being aluminum and inevitable impurities.

However, the composition is not limited thereto and as long as the hypereutectic aluminum-silicon alloy contains silicon: 20.0 to 30.0% by mass and aluminum: 60% by mass or more, and also contains one or more selected from the group consisting of copper (Cu): 0.5% by mass to 1.5% by mass, magnesium (Mg): 0.5% by mass to 4.0% by mass, nickel (Ni): 0.5% by mass to 1.5% by mass, zinc (Zn): 0.2% by mass or less, iron (Fe): 0.8% by mass or less, manganese (Mn): 2.0% by mass or less, beryllium (Be): 0.001% by mass to 0.01% by mass, phosphorus (P): 0.005% by mass to 0.03% by mass, sodium (Na): 0.001% by mass to 0.01% by mass, and strontium (Sr): 0.005% by mass to 0.03% by mass, any element may be further added for the purpose of improving various characteristics of the obtained formed article.

EXAMPLES

Example 1

1. Production of Samples

Three alloy compositions of an alloy 1 containing 20.0% by mass of silicon, with the balance being aluminum and inevitable impurities, an alloy 2 containing 25.0% by mass of silicon, with the balance being aluminum and inevitable impurities, and an alloy 3 containing 30.0% by mass of silicon, with the balance being aluminum and inevitable impurities, were used.

Alloy 1: Si: 20.17% by mass, Fe: 0.21% by mass, Cu: 0.01% by mass, Mn: 0.02% by mass, Mg: 0.02% by mass, Cr: 0.01% by mass, Zn: 0.02% by mass, Ti: 0.02% by mass, and Ni: 0.03% by mass Alloy 2: Si: 25.24% by mass, Fe: 0.19% by mass, Cu: 0.00% by mass, Mn: 0.03% by mass, Mg: 0.03% by mass, Cr: 0.03% by mass, Zn: 0.03% by mass, Ti: 0.03% by mass, and Ni: 0.03% by mass Alloy 3: Si: 30.35% by mass, Fe: 0.23% by mass, Cu: 0.00% by mass, Mn: 0.02% by mass, Mg: 0.01% by mass, Cr: 0.01% by mass, Zn: 0.03% by mass, Ti: 0.02% by mass, and Ni: 0.01% by mass Liquidus temperatures determined from phase diagrams of the alloy 1, the alloy 2 and the alloy 3 are 690° C., 760° C. and 828° C., respectively.

Using a die casting apparatus 100 (KDK 50C-30 Cold Chamber, manufactured by KDK Machine Co., Ltd.) shown in FIG. 1, die casting was performed under the conditions shown in Table 1 (alloy, molten metal temperature (temperature at which a molten metal is tapped from a ladle 20), and injection starting temperature) to produce a megaphone-shaped die-cast member having an upper end side (end portion in an extending direction) outer diameter of 48 mm, a height of 55 mm (height of a product portion: 51 mm), and a thickness (thickness Tm) of 0.7 mm.

Figure 7:
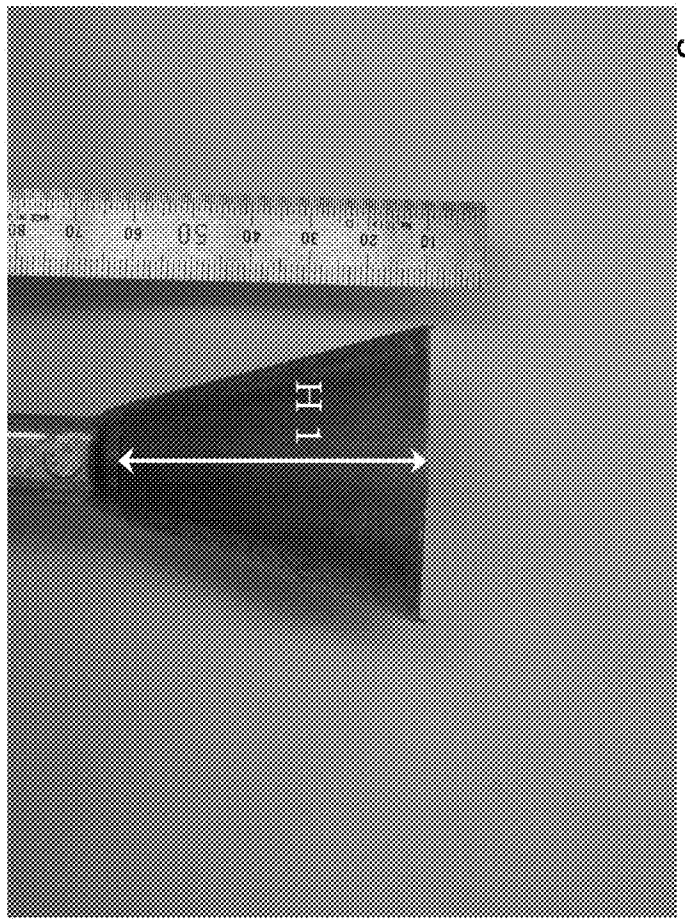
FIG. 7 is a photograph showing an appearance of the obtained die-cast member (Example 1-12).

FIG. 7 is a photograph showing an appearance of the obtained die-cast member (Example 1-12). Regarding the portion having a height H1 shown in FIG. 7 as the height of a product portion, a surface area S was determined by calculating the total areas of the respective external side face, internal side face, upper end face and lower end face of a megaphone shape having an opening at the upper portion and the lower portion, and found to be 113 $cm^2$. As is apparent from FIG. 7, slight unevenness is observed at the upper end face and an area of the upper end face was determined as a smooth surface.

The injection starting temperature was controlled by determining cooling characteristics (relation between time and temperature) of a molten metal in a sleeve in advance with respect to alloys 1 to 3, and controlling an elapse time in the sleeve. The injection rate was 1.0 m/s or less.

TABLE 1

| | Alloy | Molten metal temperature (° C.) | Injection starting temperature (° C.) |
|---|---|---|---|
| Example 1-1 | Alloy 1 | 800 | 577 |
| Example 1-2 | Alloy 1 | 800 | 580 |
| Example 1-3 | Alloy 1 | 800 | 600 |

TABLE 1-continued

| | Alloy | Molten metal temperature (° C.) | Injection starting temperature (° C.) |
|---|---|---|---|
| Example 1-4 | Alloy 1 | 800 | 630 |
| Example 1-5 | Alloy 1 | 800 | 650 |
| Example 1-6 | Alloy 1 | 800 | 680 |
| Example 1-7 | Alloy 2 | 800 | 580 |
| Example 1-8 | Alloy 2 | 800 | 600 |
| Example 1-9 | alloy 2 | 800 | 620 |
| Example 1-10 | Alloy 2 | 800 | 630 |
| Example 1-11 | Alloy 2 | 800 | 650 |
| Example 1-12 | Alloy 2 | 800 | 700 |
| Example 1-13 | Alloy 2 | 800 | 740 |
| Example 1-14 | Alloy 3 | 830 | 600 |
| Example 1-15 | Alloy 3 | 830 | 610 |
| Example 1-16 | Alloy 3 | 830 | 620 |
| Example 1-17 | Alloy 3 | 830 | 670 |
| Example 1-18 | Alloy 3 | 830 | 720 |
| Comparative Example 1-1 | Alloy 2 | 830 | 800 |
| Comparative Example 1-2 | Alloy 2 | 800(*) | 680 |

(*)cooled to 700° C. in ladle

As shown in Table 1, two Comparative Examples (Comparative Example 1 and Comparative Example 2) were fabricated with respect to an alloy 2. Comparative Example 1-1 is a sample in which the injection starting temperature is set at 800° C. which is higher than the liquidus temperature. Comparative Example 1-2 is a sample in which a molten metal at 800° C. was subjected to a semi-solidification treatment of cooling to 700° C., which is the temperature of liquidus temperature or lower, in about 3 minutes in a ladle 20, followed by tapping from the ladle 20.

2. Sample Evaluation Results (1) Surface Observation of Die-Cast Member

With respect to the thus obtained samples of Examples and Comparative Examples, surface observation was performed. With respect to each sample, ten megaphone-shaped die-cast members mentioned above were produced and then surface observation of all ten samples was performed.

If surface wrinkles or cracks are recognized in any one of ten samples, the sample was rated "D". If surface roughening (surface roughening corresponding to the level causing no problem in various uses, which cannot be often clearly recognized by a photograph) is recognized in any one of ten samples, the sample was rated "B". If cracks, surface wrinkles, and surface roughening are not recognized in any one of ten samples, the sample was rated "A". If surface roughening is recognized in any one of ten samples, and also unfilling occurred in the case of confirming reproducibility (sample in which unfilling occurred, although it seldom occurs), the sample was rated "C".

Figure 5:
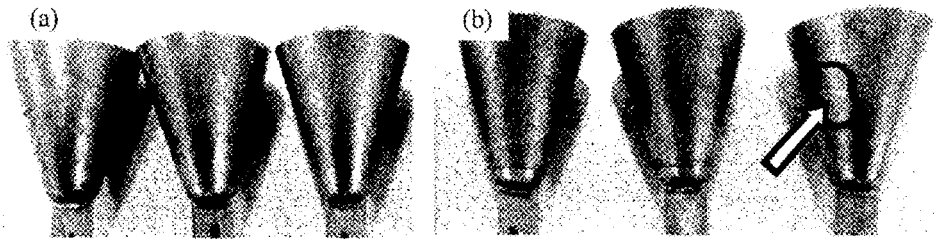
FIG. 5 is a photograph showing an example of a die-cast member on which surface observation was conducted, in which FIG. 5(*a*) shows a photograph of Example 1-12 and FIG. 5(*b*) show a photograph of Comparative Example 1-1.

The surface observation results are shown in Table 2. A photograph of Example 1-12 is shown in FIG. 5(*a*) as an example of a die-cast member subjected to surface observation, and a photograph of Comparative Example 1-1 is shown in FIG. 5(*b*). In the example of FIG. 5(*a*), all samples exhibited satisfactory surface state. Meanwhile, in the example of FIG. 5(*b*), as indicated by arrow in the drawing, surface wrinkles were recognized in the rightmost die-cast member. In Comparative Example 1-1, surface wrinkles were recognized in three die-cast members of ten die-cast members.

Figure 4:
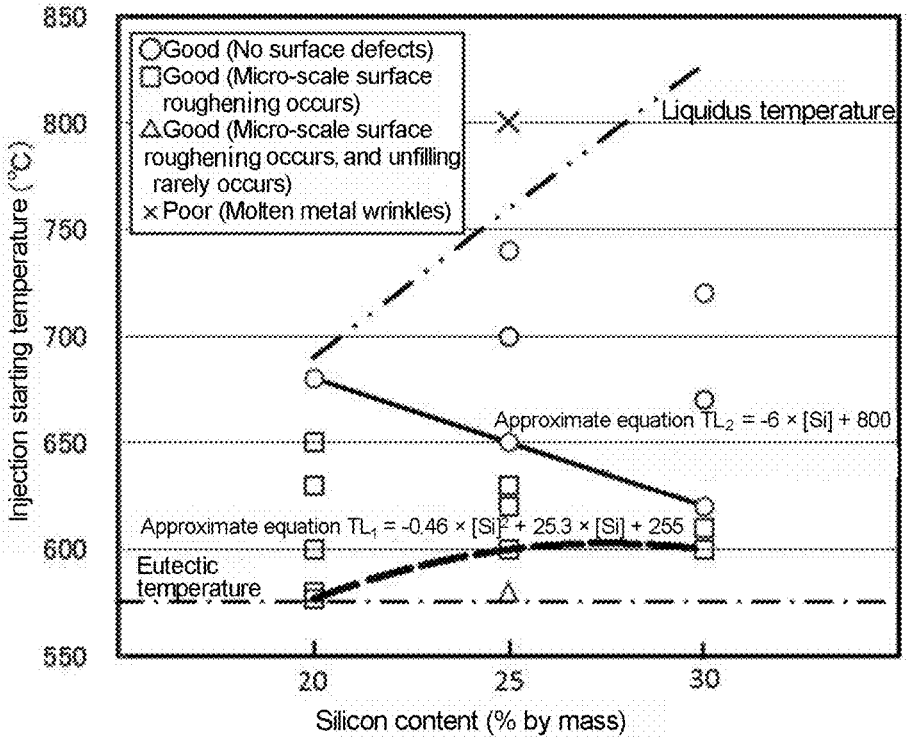

FIG. 4 is a graph showing a relation between the injection starting temperature and the silicon content, and the die castability, in which the results of Examples 1-1 to 1-16 and Comparative Example 1-1 are collectively shown.

It is judged whether or not surface wrinkles exist by comparing with "die-cast cast surface standard specimen (production method was changed), Number of standard specimens: 24, Issue Date: August, 2007" provided by Japan Die Casting Association.

TABLE 2

| | Surface observation results |
|---|---|
| Example 1-1 | B |
| Example 1-2 | B |
| Example 1-3 | B |
| Example 1-4 | B |
| Example 1-5 | B |
| Example 1-6 | A |
| Example 1-7 | C |
| Example 1-8 | B |
| Example 1-9 | B |
| Example 1-10 | B |
| Example 1-11 | A |
| Example 1-12 | A |
| Example 1-13 | A |
| Example 1-14 | B |
| Example 1-15 | B |
| Example 1-16 | A |
| Example 1-17 | A |
| Example 1-18 | A |
| Comparative Example 1-1 | D (Surface wrinkles) |
| Comparative Example 1-2 | D (Cracks) |

As is apparent from Table 1 and FIG. 4, all samples of Examples are practically usable since neither cracks nor surface wrinkles are recognized.

It is apparent that micro-scale surface roughening is not recognized and the obtained die-cast member is extremely excellent in surface property when the injection starting temperature is the temperature represented by the following equation (2) determined by FIG. 4 or higher:

$$TL_2\ (°\ C.) = -6 \times [Si] + 800 \quad (2)$$

where [Si] is the silicon content represented by % by mass of a molten metal 10 (i.e. hypereutectic aluminum-silicon alloy).

It is also apparent that unfilling does not occur when the injection starting temperature is the temperature represented by the following equation (1) determined by FIG. 4.

Meanwhile, it is possible to usually obtain a die-cast member in a surface state causing no problem in various uses even in the case of selecting, as the injection starting temperature, the temperature between the temperature $TL_1$ determined by the equation (1) and the eutectic temperature. However, a desired die-cast member cannot be sometimes obtained since unfilling rarely occurs. In other words, in the case of producing numerous die-cast members corresponding to the level causing no problem under these conditions, there is a need to visually inspect the obtained die-cast member so as to surely find defective products caused by unfilling which can rarely appear.

$$TL_1\ (°\ C.) = -0.46 \times [Si]^2 + 25.3 \times [Si] + 255 \quad (1)$$

where [Si] is the silicon content represented by % by mass of a hypereutectic aluminum-silicon alloy To the contrary, surface wrinkles are recognized in Comparative Example 1 and cracks are recognized in Comparative Example 2, thus making it clear that they are inferior in surface property.

(2) Average Size of Primary Crystal Si

With respect to samples of all Examples and Comparative Example 2, the average size of a primary crystal Si was measured. Each sample was cut at three different locations (root portion near injection side, center portion and tip side portion) in the direction perpendicular to a molten metal flow direction. With respect to arbitrary position of a cross-section, an image was taken at a visual field dimension of 1 mm×0.7 mm by changing a magnification of an optical microscope. After framing so that thirty primary crystals Si having a complete shape are included in the visual field, the average size was determined and also the average size of the primary crystal Si was determined by taking an average of the above three locations. The size of the primary crystal Si was determined by measuring a maximum diameter (maximum length) of the crystal.

In all samples of Examples, the primary crystal Si had a massive shape or rosette shape, and has the average size of 0.08 mm. Meanwhile, in Comparative Example 1-2, the primary crystal Si had a plate-like shape and had the average size of 1 mm.

Figure 6:
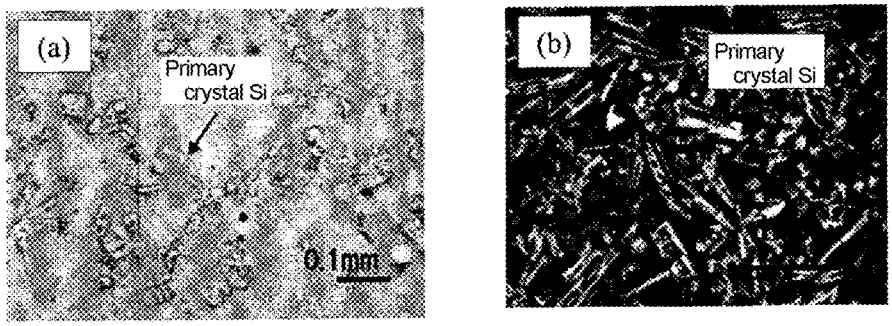
FIG. 6 is an example of optical microscopic observation results, in which FIG. 6(*a*) shows optical microscopic observation results of Example 1-12 and FIG. 6(*b*) shows optical microscopic observation results of Comparative Example 1-2.

FIG. 6 shows an example of the optical microscopic observation results, in which FIG. 6(*a*) shows the optical microscopic observation results of Example 1-12 and FIG. 6(*b*) shows the optical microscopic observation results of Comparative Example 1-2. In both FIGS. 6(*a*) and 6(*b*), a typical primary crystal Si was indicated by arrow.

Example 2

1. Production of Samples

The alloy 2 used in Example 1 was used as the samples of Example 2-1 and Example 2-2. As the sample of Comparative Example 2-1, an ADC12 alloy (Si: 10.91% by mass, Cu: 1.88% by mass, Zn: 0.85% by mass, Fe: 0.77% by mass, Mg: 0.26% by mass, Mn: 0.22% by mass, Ni: 0.06% by mass, Ti: 0.04% by mass, Pb: 0.04% by mass, Sn: 0.03% by mass, Cr: 0.05% by mass, Cd: 0.0015% by mass, with the balance being aluminum) was used.

The liquidus temperature of the ADC alloy used is 580° C.

Using die casting apparatus 100 shown in FIG. 1, die casting was performed under the conditions (alloy, molten metal temperature (temperature at which a molten metal is tapped from a ladle 20) shown in Table 3, and injection starting temperature) to produce a fin-shaped die-cast member.

Figure 8:
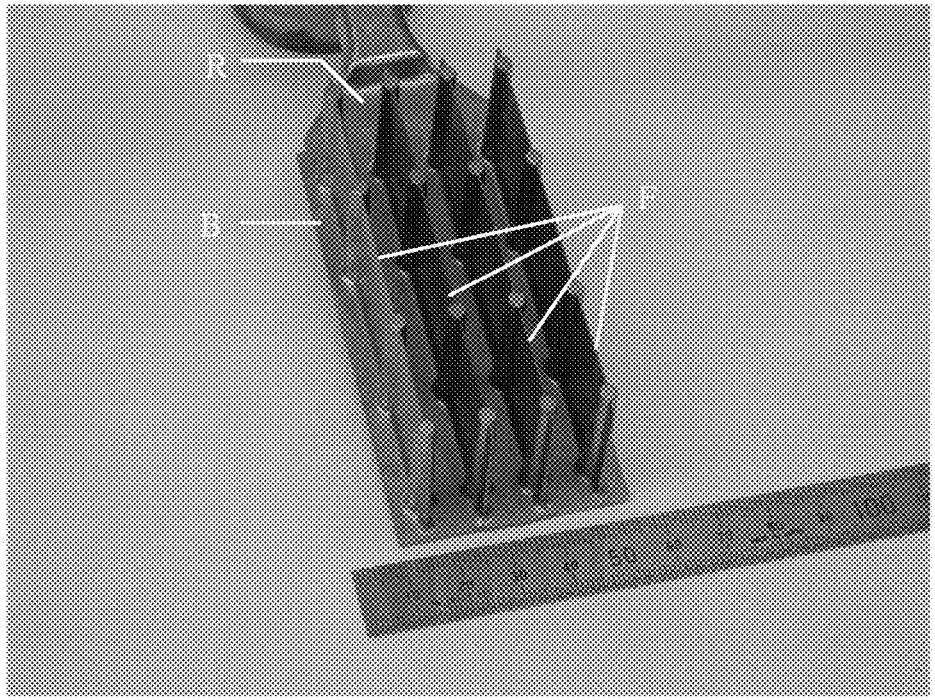
FIGS. 8(*a*) and 8(*b*) are photographs showing an appearance of the obtained fin-shaped die-cast member (Example 2-2).
Figure 8:
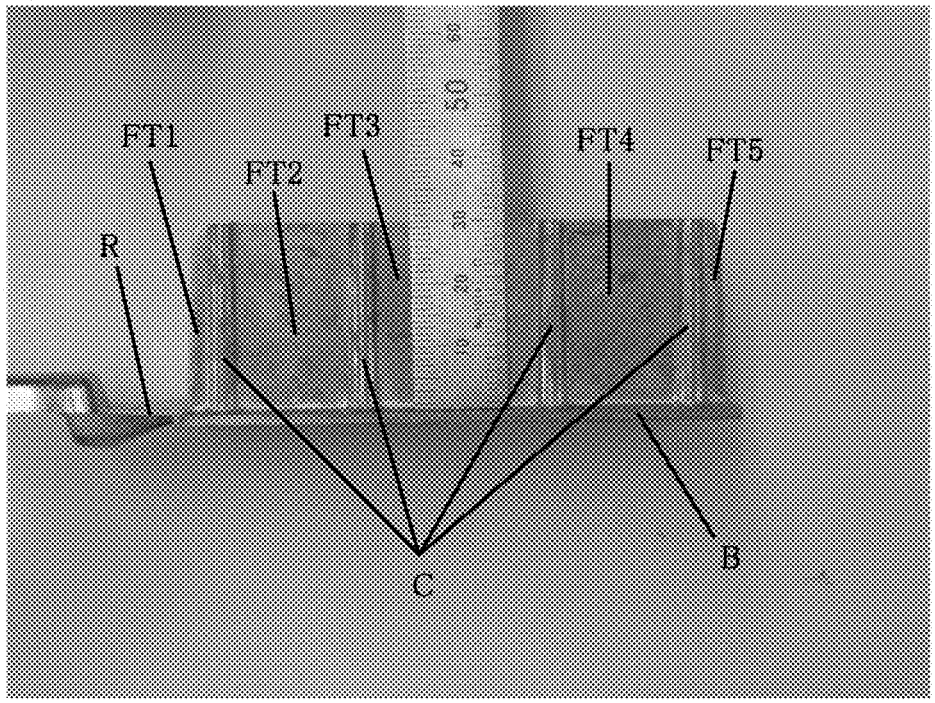

FIG. 8(*a*) and FIG. 8(*b*) are photographs showing an appearance of the obtained fin-shaped die-cast member (Example 2-2). The obtained die-cast member includes four fin portions F on a pedestal (base plate) B measuring 90 mm in length×45 mm in width×2 mm in thickness, formed by connecting to a runner R.

In the fin portion F, the proximal end side (pedestal side) has a length of 56 mm, and the distal end side (upper side) has a length of 84.3 mm. The fin portion F consists of four column portions C each having a truncated conical shape, and five fin thin wall portions FT1 to FT5 disposed so as to interpose each of these four column portions C. In the column portion C, the proximal end portion has a diameter of 5 mm, and the distal end side has a diameter of 4 mm and a height of 30 mm. Each of fin thin wall portions FT1 to FT5 has a thickness of 0.5 mm, a height of 30 mm and a draft angle of 0.5 degree.

Such die-cast member is regarded as a heat dissipation product (heat dissipation member) having a thickness Tm of 2 mm (thickness of the thickest portion of the member is 2 mm), including a pedestal portion B and four fin portions F. In this case, the product portion has a surface area S of 267.8 $cm^2$.

When the pedestal portion B is used as a runner, in other words, the each fin portion is used as a fin product (fin member) after removing from the pedestal portion B, it is possible to regard as one fin member including a plurality of thin portions each having a thickness Tm of 0.5 mm at comparatively small intervals of 5 mm or less (namely, fin thin wall portions FT1 to FT5 are respectively connected to other adjusting fin thin wall portion by a column portion C). In this case, a surface area S of the product portion becomes 40.8 $cm^2$.

Regarding Comparative Example 2-1, since it was expected that run of the molten metal in a mold is poor, a die-cast member including a fin portion having a height (heights of fin thin wall portions FT1 to FT5 and column portion C) decreased to 25 mm (other shape conditions are the same as those in Examples 2-1 and 2-2) was obtained. The die-cast member has a surface area S of 237.8 $cm^2$ for a heat dissipation member, and has a surface area S of 34.2 $cm^2$ for a fin member.

The injection starting temperature was controlled by determining cooling characteristics (relation between time and temperature) of a molten metal in a sleeve in advance with respect to alloy 2 and ADC12, and controlling an elapse time in the sleeve. The injection rate was about 1.0 m/s.

TABLE 3

| | Alloy | Molten metal temperature (° C.) | Injection starting temperature (° C.) | Height (mm) of fin portion |
|---|---|---|---|---|
| Example 2-1 | Alloy 2 | 850 | 740 | 25 |
| Example 2-2 | Alloy 2 | 850 | 740 | 30 |
| Comparative Example 2-1 | ADC12 | 850 | 750 | 25 |

2. Sample Evaluation Results (1) Surface Observation of Die-Cast Member

With respect to the thus obtained samples of Examples and Comparative Examples, surface observation was performed. With respect to each sample, ten die-cast members mentioned above were produced and then surface observation of all ten samples was performed in the same manner as in Example 1.

The surface observation results are shown in Table 4. FIGS. 8(*a*) and 8(*b*) mentioned above show an example of a die-cast member (Example 2-2) subjected to surface observation. In Examples 2-1 and 2-2, all samples exhibited satisfactory surface state. Meanwhile, in Comparative Example 2-1, regardless of a decrease in height of the die-cast member as mentioned above, die casting was performed by increasing an injection rate to 1.5 m/s estimated by valve opening (limit rate at which burr does not generate). However, because of insufficient run of the molten metal in a mold, through holes and unfilled portions were generated in a die-cast member, especially a fin thin wall portion.

Figure 10:
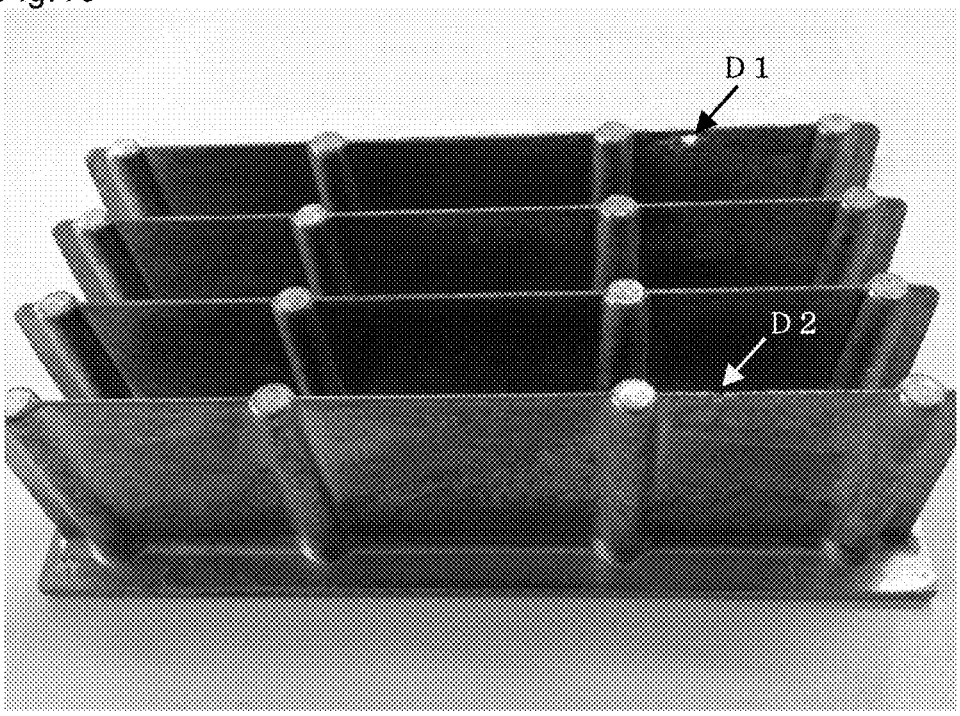
FIG. 10 shows an example of surface observation results of a sample of Comparative Example 2-1.

FIG. 10 shows surface observation results of the sample of Comparative Example 2-1. Arrow D1 in FIG. 10 indicates a through hole and arrow D2 indicates an unfilled portion.

TABLE 4

| | Surface observation results |
|---|---|
| Example 2-1 | A |
| Example 2-2 | A |
| Comparative Example 2-1 | D (through holes, unfilled portions) |

As shown in Table 4, it is apparent that micro-scale surface roughening is not recognized in both Examples 2-1 and 2-2 in which the injection starting temperature is the temperature represented by the following equation (2) determined from FIG. 4 or higher, and the obtained die-cast member is extremely excellent in surface property.

$$TL_2\ (^\circ\ C.)=-6\times[Si]+800 \quad (2)$$

where [Si] is the silicon content represented by % by mass of a molten metal 10 (i.e. hypereutectic aluminum-silicon alloy)

(2) Average Size of Primary Crystal Si

With respect to samples of Examples 2-1 and 2-2, the average size of a primary crystal Si was measured. Each sample was cut at three different locations of the fin thin portion (proximal side portion, center portion and distal side portion) in the direction perpendicular to a molten metal flow direction. With respect to arbitray position of a cross-section, an image was taken at a visual field dimension of 1 mm×0.7 mm by changing a magnification of an optical microscope. After framing so that thirty primary crystals Si having a complete shape are included in the visual field, the average size was determined and also the average size of the primary crystal Si was determined by taking an average of the above three locations. The size of the primary crystal Si was determined by measuring a maximum diameter (maximum length) of the crystal.

In all samples of Examples, a primary crystal Si had a massive shape or a rosette shape, and had the average size of 77 μm (0.077 mm).

Figure 9:
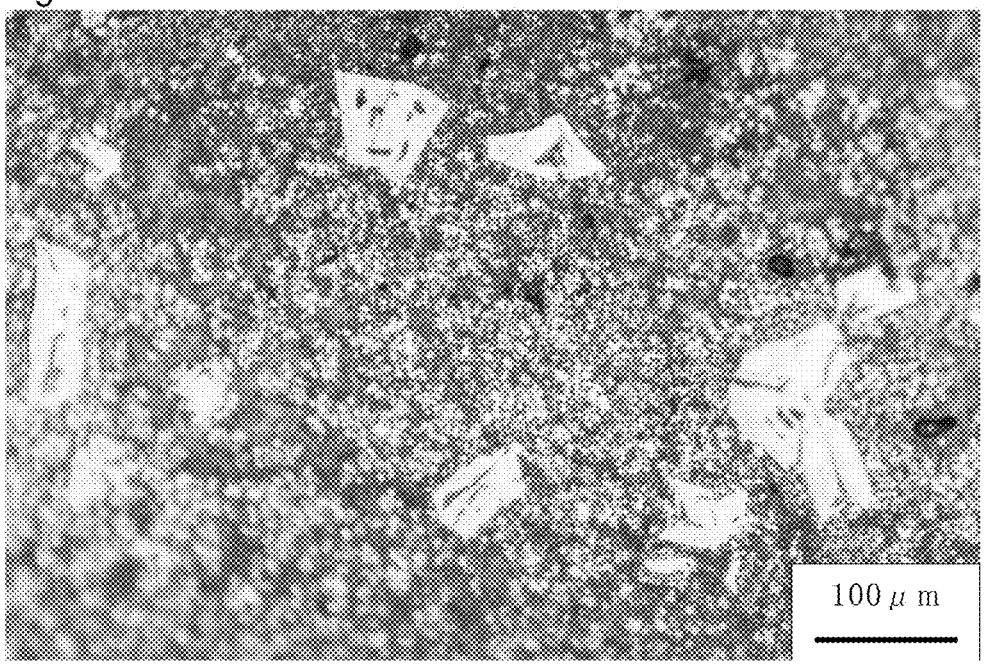
FIG. 9 shows optical microscopic observation results of Example 2-2.

FIG. 9 shows optical microscopic observation results of Example 2-2.

This application claims priority to Japanese Patent Application No. 2012-211241, the disclosure of which is incorporated by reference herein.

DESCRIPTION OF REFERENCE NUMERALS

2 Sleeve
4 Plunger
6 Mold
10 Molten metal
20 Ladle
22 Cooling device
100, 100A Die casting device

The invention claimed is:

1. A method for producing a die-cast member, which comprises the steps of:

1) preparing a molten metal of a hypereutectic aluminum-silicon alloy containing 20.0% by mass to 30.0% by mass of silicon, the molten metal having a temperature higher than the liquidus temperature of the alloy, and supplying the molten metal in a sleeve while no primary crystal Si is crystallized in the molten metal; and 2) moving a plunger inserted into the sleeve immediately after the temperature of the molten metal in the sleeve reaches an injection starting temperature set in advance at a temperature between the liquidus temperature and the eutectic temperature of the hypereutectic aluminum-silicon alloy, and injecting the molten metal in a semi-solidified state thereby filling a cavity of a mold with the molten metal, wherein the injection starting temperature is a starting temperature of crystallization of the primary crystal Si, wherein the injection starting temperature of the step 2) lies between the lower limit temperature $TL_2$ represented by the equation (2) shown below and the liquidus temperature of the hypereutectic aluminum-silicon alloy:

$$TL_2\ (^\circ\ C.)=-6\times[Si]+800 \quad (2)$$

where [Si] is the silicon content represented by % by mass of a hypereutectic aluminum-silicon alloy.

2. The method according to claim 1, wherein, in the step 1), the temperature of the molten metal to be supplied in the sleeve is higher than the liquidus temperature of the hypereutectic aluminum-silicon alloy by a difference within 50° C.

3. The method according to claim 1, wherein the hypereutectic aluminum-silicon alloy consists of aluminum, silicon, and inevitable impurities.

4. The method according to claim 1, wherein the hypereutectic aluminum-silicon alloy comprises:

aluminum (Al): 60.0% by mass or more, silicon (Si), and one or more selected from the group consisting of copper (Cu): 0.5% by mass to 1.5% by mass, magnesium (Mg): 0.5% by mass to 4.0% by mass, nickel (Ni): 0.5% by mass to 1.5% by mass, zinc (Zn): 0.2% by mass or less, iron (Fe): 0.8% by mass or less, manganese (Mn): 2.0% by mass or less, beryllium (Be): 0.001% by mass to 0.01% by mass, phosphorus (P): 0.005% by mass to 0.03% by mass, sodium (Na): 0.001% by mass to 0.01% by mass, and strontium (Sr): 0.005% by mass to 0.03% by mass.

* * * * *